US005207383A

United States Patent [19]

Hans et al.

[11] Patent Number: 5,207,383

[45] Date of Patent: May 4, 1993

[54] DEVICE FOR INJECTING A FUEL/AIR MIXTURE INTO AN INTERNAL COMBUSTION SYSTEM

[75] Inventors: Waldemar Hans, Bamberg; Ingo Kirsche, Hallstadt, both of Fed. Rep. of Germany

[73] Assignee: Robert Bosch GmbH, Stuttgart, Fed. Rep. of Germany

[21] Appl. No.: 768,961

[22] PCT Filed: Jan. 21, 1991

[86] PCT No.: PCT/DE91/00048

§ 371 Date: Oct. 9, 1991

§ 102(e) Date: Oct. 9, 1991

[87] PCT Pub. No.: WO91/12427

PCT Pub. Date: Aug. 22, 1991

[30] Foreign Application Priority Data

Feb. 16, 1990 [DE] Fed. Rep. of Germany ..... 4004897

[51] Int. Cl.[5] ..... B05B 7/12; F02M 61/16

[52] U.S. Cl. ..... 239/409; 239/417.3; 239/434; 239/533.12; 123/531; 123/585

[58] Field of Search ..... 239/408, 409, 410, 417.3, 239/533.15, 533.12, 433, 434, 412; 123/531, 585

[56] References Cited

U.S. PATENT DOCUMENTS

| | | | |
|---|---|---|---|
| 3.272,441 | 9/1966 | Davis, Sr. et al. | 239/434 |
| 3,656,693 | 4/1972 | Eckert | 239/410 |
| 4,434,766 | 3/1984 | Matsuoka et al. | 122/531 |
| 4,519,370 | 5/1985 | Iwata | 123/585 |
| 4,545,354 | 10/1985 | Jaggle et al. | 123/585 |
| 4,566,634 | 1/1986 | Wiegand | 123/585 |
| 4,957,241 | 9/1990 | Roger | 239/409 |
| 4,982,716 | 1/1991 | Takeda et al. | 239/533.12 |
| 5,035,358 | 7/1991 | Katsuno et al. | 239/433 |

FOREIGN PATENT DOCUMENTS

| | | | |
|---|---|---|---|
| 2746863 | 4/1979 | Fed. Rep. of Germany | 239/417.3 |
| 3240554 | 3/1984 | Fed. Rep. of Germany . | |
| 3704330 | 10/1987 | Fed. Rep. of Germany . | |
| 0043962 | 3/1984 | Japan | 239/410 |

*Primary Examiner*—Andres Kashnikow
*Assistant Examiner*—Christopher G. Trainor
*Attorney, Agent, or Firm*—Edwin E. Greigg; Ronald E. Greigg

[57] ABSTRACT

A fuel/air mixture device for a dual injection valve including a single-part element which is suitable for various fuel injection valves without further adjustment measures. The single part element includes an envelope bush portion in contact with the injection end of the fuel injection valve in the form of stop surfaces and, together with this injection end, forms a narrow air gap so that the air is accelerated to almost sonic velocity and the fuel sprayed from the fuel injection openings is finely atomized. The device is particularly suitable for injecting a fuel air mixture into the induction pipe of an internal combustion engine with externally induced ignition.

26 Claims, 3 Drawing Sheets

DEVICE FOR INJECTING A FUEL/AIR MIXTURE INTO AN INTERNAL COMBUSTION SYSTEM

STATE OF THE ART

Figure 1:
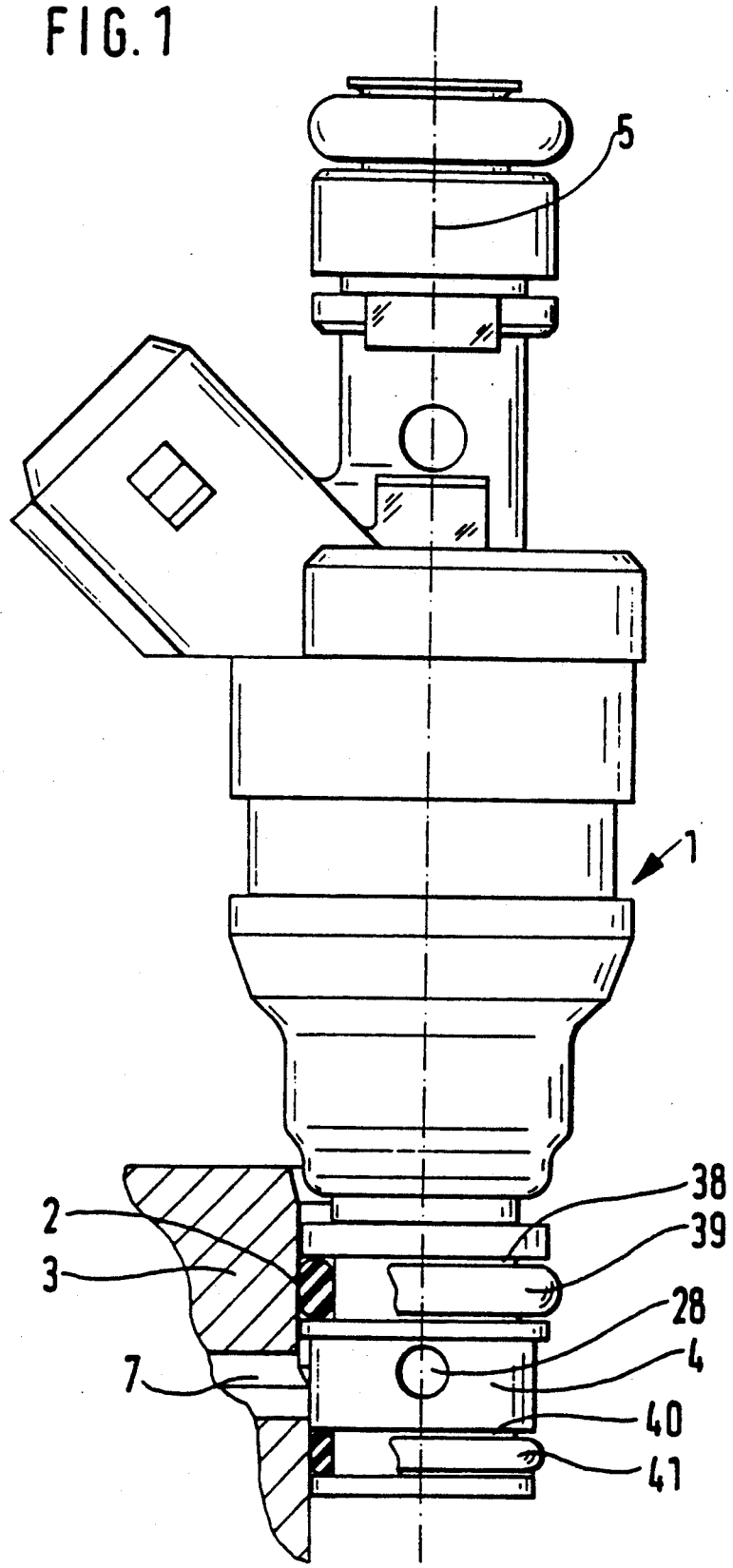

The invention is based on a device for injecting a fuel/air mixture. A device is already known for injecting a fuel/air mixture (DE-Offenlegungsschrift 3,240,554); this involves an injection valve with a gas guidance sleeve, the injection valve opening being surrounded in its immediate vicinity by a gas annular gap connected to a gas annular duct, on the gas guidance sleeve. It is only possible to match the gas annular gap to the requirements of the internal combustion engine and the different types of injection valves by displacing or bending the gas guidance sleeve; this involves great complexity so that the manufacture of this known device by mass production causes large costs due to the optimisation of the gas annular gap.

ADVANTAGES OF THE INVENTION

The device, according to the invention, for injecting a fuel/air mixture has, in contrast, an advantage that an envelope of air can be produced on a fuel injection valve in a simple manner and at favourable cost without adjustment of the gas annular gap being necessary during assembly because this gas annular gap is fixed by selecting an air envelope bush which is designed to suit the particular requirements. The use of different air envelope bushes permits the air quantity to be matched to the particular requirements of the internal combustion engine without any further adjustment being necessary.

Exact maintenance of the defined air gap is ensured, without an adjustment procedure, exclusively by directly supporting the air envelope bush on the injection end of the fuel injection valve. The small height of the air gap ensures that the induction air is accelerated to approximately sonic velocity and the fuel sprayed from the fuel spray openings is therefore finely atomised.

The simple construction of the air envelope bush, in association with different fuel injection valves, leads to favourable manufacturing costs.

Advantageous extensions and improvements to the device are possible by means of the measures set forth hereinafter.

It is particularly advantageous for the mixture spray opening to expand a funnel shape away from the injection end so that fuel emerging from the fuel injection opening cannot wet the mixture spray opening wall even in the case of erroneous air preparation.

It is also advantageous for at least one air supply opening to be formed in the cylindrical part of the air envelope bush, this air supply opening permitting a radial air supply, for example from an air duct formed in the induction pipe of the internal combustion engine, in the direction of the annular surface of the bottom part.

The formation of a defined air gap between the annular surface and the injection end requires an accurately maintained location between the fuel injection valve and the air envelope bush. For this reason, it is advantageous for the stop surfaces to be formed by an external, interrupted annular protrusion of the bottom part, which annular protrusion, because of the numerous stop surfaces protruding by a predetermined distance above the annular surface, not only permits exact contact between the air envelope bush and the fuel injection valve but also permits a reliable air supply to the annular surface by means of the recesses formed in the interrupted annular protrusion.

So that the air gap formed between the annular surface of the air envelope bush and the injection end of the fuel injection valve can be modified in a simple manner and at favourable cost for different cylinders of an internal combustion engine with externally induced ignition or even internal combustion engines, it is advantageous for at least one distance piece to be arranged between the injection end and the contact surfaces of the air envelope bush.

It is also advantageous for the annular surface to be formed by an inner annular protrusion which has a predetermined axial distance from the injection end and thus permits the simple formation of a narrow air gap.

In order to even out the air supply to the air gap and to avoid disturbing turbulence, it is advantageous, in the design of the annular protrusion according to the invention, for at least part of the inside of the bottom part between the stop surfaces and the inner annular protrusion to be designed to extend obliquely towards the injection end in the radial direction towards the annular surface.

The formation of a peripheral air supply groove in a cylindrical inner wall of the cylindrical part, into which groove the at least one air supply opening emerges, has the advantage of an improved air supply from the air supply opening, past the lower end of the fuel injection valve to the annular surface.

A seal for the at least one air supply opening is necessary between the acceptance feature of the induction pipe of an internal combustion engine and the periphery of the air envelope bush, in which acceptance feature, the device according to the invention is mounted. For this purpose, it is advantageous for an annular groove to be formed on the periphery of the air envelope bush on each side of the air supply opening, these grooves being used to accept an upper sealing ring and a lower sealing ring.

DRAWING

Illustrative examples of the invention are shown in simplified form in the drawing and are explained in more detail in the following description.

Figure 2:
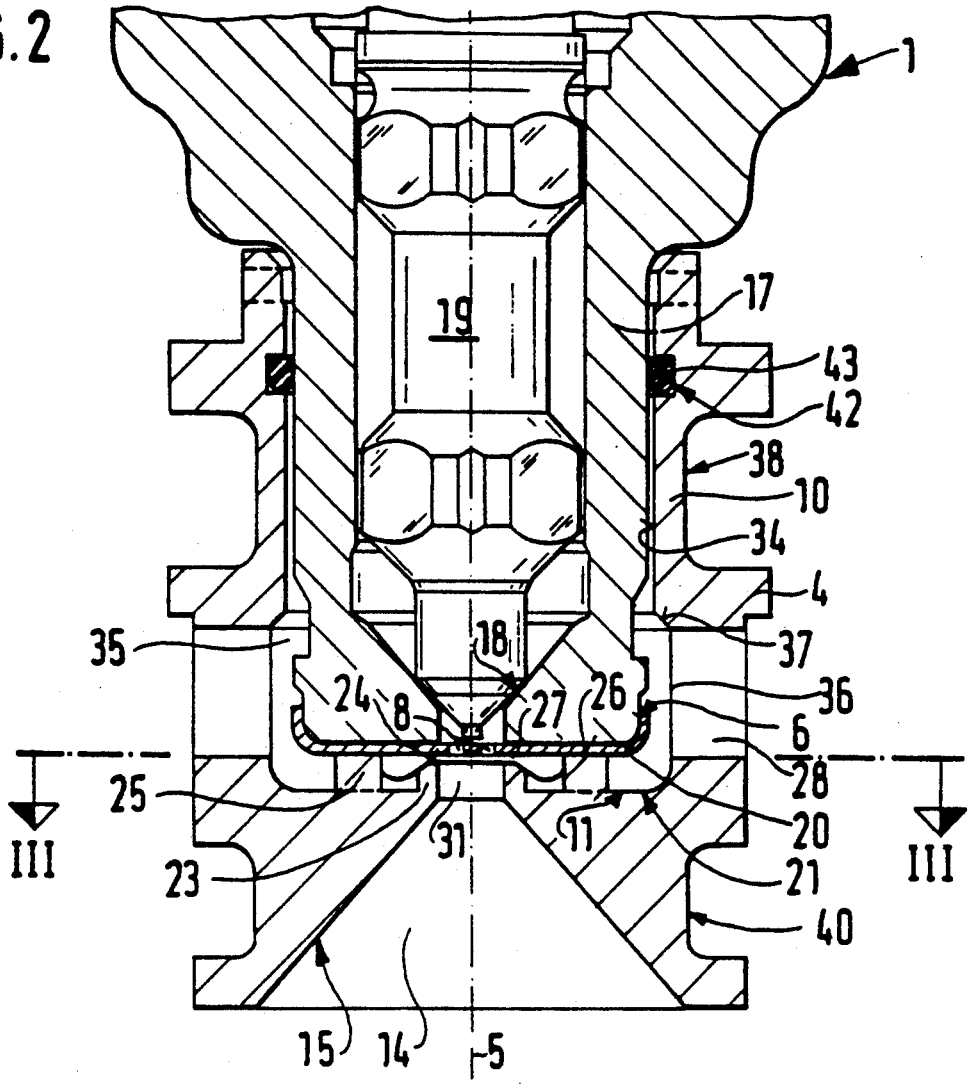
Figure 3:
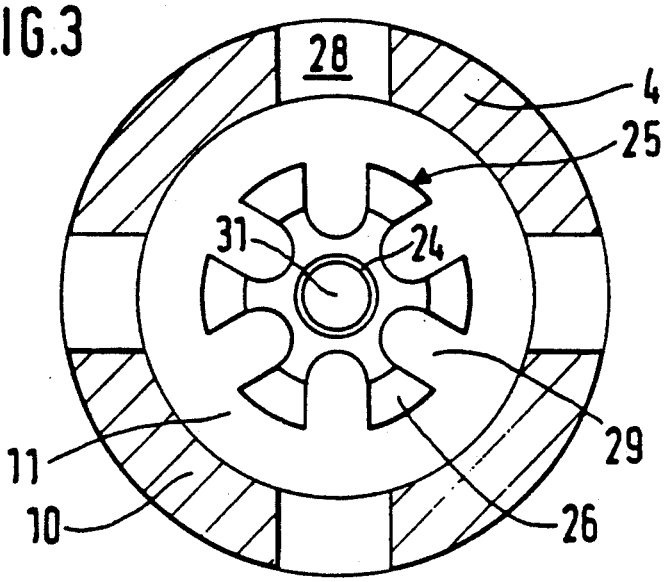
Figure 4:
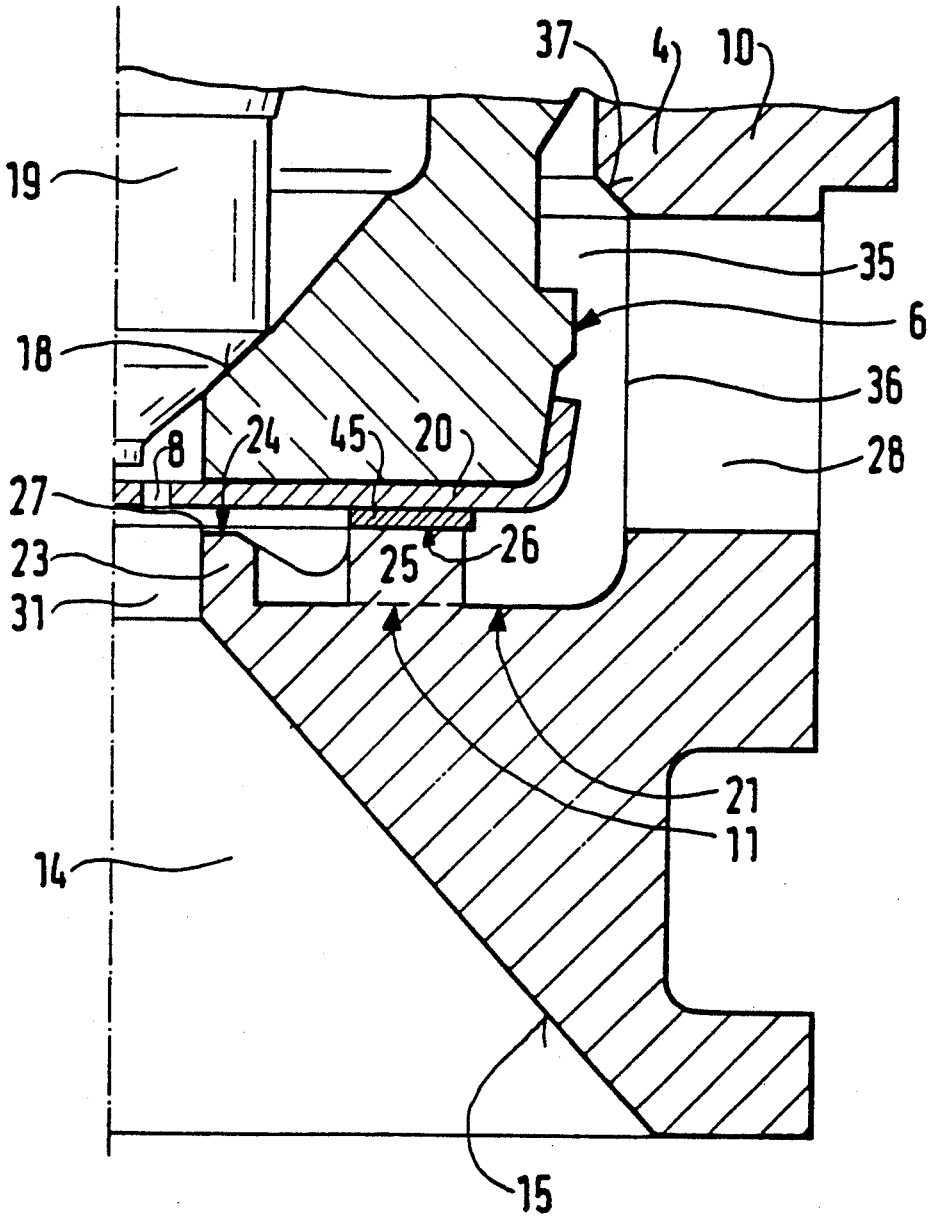

FIG. 1 shows a first illustrative example of the device according to the invention, FIG. 2 shows a partial section through the device, FIG. 3 shows a section along the line III—III in FIG. 2 and FIG. 4 shows an enlarged excerpt of a second illustrative example.

DESCRIPTION OF THE ILLUSTRATIVE EXAMPLES

The device for injecting a fuel/air mixture shown, as an example in FIG. 1, has a fuel injection valve 1 that is mounted in an injection valve acceptance feature 2 of an induction pipe 3 of an internal combustion engine. An air envelope bush 4 of the device surrounds an injection end 6, concentrically with a valve longitudinal axis 5, shown in FIG. 2, of the fuel injection valve 1. The air supply (branched off, for example, by a bypass before a throttle butterfly in the induction pipe 3 or pumped by an auxiliary fan) to the air envelope bush 4 takes place by means of at least one air duct 7 formed in the induction pipe 3.

The illustrative example shown in FIG. 2, only partially in section, shows the pot-shaped design of air envelope bush 4, which has a cylindrical part 10, a bottom part 11 and, in the bottom part, a cylindrical mixture opening 31 extending concentrically with the valve longitudinal axis, and a mixture spray opening 14 extending downstream in funnel shape and having a mixture spray opening wall 15. The lower injection end 6 (with two fuel injection openings 8 in the illustrative example) of the fuel injection valve 1 is surrounded, at least partially in the axial direction, by the cylindrical part 10 and, at least partially in the radial direction, by the bottom part 11. In the illustrative example shown, the fuel injection valve 1 has a valve needle 19 interacting with a fixed conical valve seating surface 18 in a valve housing 17. The fuel injection openings 8 are therefore formed in a so-called aperture washer 20, which is arranged downstream of the valve seating surface 18 as part of the injection end 6.

An inner annular protrusion 23 extending radially to the mixture opening 31 is formed on the inside 21 of the bottom part 11 facing towards the injection end 6 of the fuel injection valve 1; this annular protrusion 23 has a flat radial annular surface 24 facing towards the injection end 6. An outer interrupted annular protrusion 25 is formed on the inside 21 of the bottom part 11 at a radial distance outwards from the inner annular protrusion 23.

As is shown in FIG. 3, which shows a section through the illustrative example along the line III—III in FIG. 2, the interrupted annular protrusion 25 has, for example, six flat stop surfaces 26 by means of which the air envelope bush 4 is in contact with the aperture washer 20 of the injection end 6 of the fuel injection valve 1. A total of six recesses 29 are formed in the interrupted annular protrusion 25 between the stop surfaces 26.

Since the stop surfaces 26 protrude in the axial direction towards the injection end 6 by a predetermined amount above the annular surface 24, a defined air gap 27 is formed between the injection end 6, or the aperture washer 20, and the annular surface 24.

At least part of the inside 21 of the bottom part 11 is designed to extend obliquely upwards towards the injection end 6 and towards the annular surface 24 in the radial direction between the interrupted annular protrusion 25 and the inner annular protrusion 23 in order to even out the flow of air to the air gap 27.

Four air supply openings 28, for example, which are used for the supply of air from the air duct 7 to the air envelope bush 4 are formed in the region of the cylindrical part 10 facing towards the injection end 6. As a departure from the illustrative example shown, it is also possible, for the purpose of generating swirl, for the attitude of the air supply openings 28 to have a tangential component relative to the valve longitudinal axis 5 and/or for the air supply openings 28 to extend obliquely relative to the valve longitudinal axis 5.

The air supply between the injection end 6, or aperture washer 20, and the bottom part 11 flows through the recesses 29 of the interrupted annular protrusion 25 via the air gap 27 to the mixture opening 31 and meets the fuel sprayed via the fuel injection openings 8. Due to the small height of the air gap 27, the air is accelerated to approximately sonic velocity and finely atomises the fuel so that the hydrocarbon emissions from the internal combustion engine are reduced, particularly during cold starting and part-load operation.

Instead of the interrupted annular protrusion 25, in an illustrative example which is not shown, at least two support towers having stop surfaces can be formed in the bottom part 11.

A peripheral air supply groove 35, which is connected to the recesses 29 and into which the air supply openings 28 emerge, is formed in a cylindrical inner wall 34 of the cylindrical part 10. The groove bottom 36 and the side surface 37 of the air supply groove 35 facing away from the fuel injection openings 8 are formed by the cylindrical inner wall 34. On the downstream side, the air supply groove 35 is bounded by the bottom part 11. The air supply groove 35 permits improved flow behaviour of the air through the air supply openings 28 and past the lower end of the fuel injection valve 1 to the air gap 27. Substantial throttling of the air flow is avoided and turbulence is reduced so that the influence on the air accelerated in the narrow air gap 27 is small.

An internal groove 42, which accepts an internal sealing ring 43, is formed above the air supply openings 28 in the cylindrical inner wall 34 facing away from the bottom part 11. The internal sealing ring 43 forms a seal between the cylindrical part 10 and the valve housing 17.

Another possibility for forming a seal between the cylindrical part 10 and the valve housing 17 consists in producing a laser sealing weld or corresponding bonding in the region of the air envelope bush 4 facing away from the injection end 6.

The fastening of the air envelope bush 4 to the fuel injection valve 1 can, for example, take place in such a way that the stop surfaces 26 of the interrupted annular protrusion 25 are connected by bonding to the injection end 6, or the aperture washer 20, of the fuel injection valve 1.

In a second illustrative example shown in FIG. 4, at least one distance piece 45 can be arranged between the injection end 6, or the aperture washer 20, of the fuel injection valve 1 and the stop surfaces 26; this distance piece 45 affects the height of the air gap 27 and thus also the air mass flow and the acceleration of the air. Identical parts and parts with similar effects are shown by the same reference numerals as those in FIGS. 1 to 3.

An upper annular groove 38, which is used to accept an upper sealing ring 39, is formed above the air supply openings 28, facing away from the bottom part 11, on the periphery of the air envelope bush 4. In order similarly to seal the air supply openings 28 on the periphery of the air envelope bush 4 outwards in the other direction on the bottom part 11, a lower sealing ring 40 is arranged in a lower annular groove 40 on the periphery of the air envelope bush 4.

According to the invention, the device for injecting a fuel/air mixture involves a single-piece element. The air envelope bush 4 can be used in an advantageous manner for various valve types but matching to different air mass flows by the use of a spacer piece or by exchanging the air envelope bush 4 is also possible without difficulty. The contact between the stop surfaces 26 of the air envelope bush 4 and the injection end 6, or the aperture washer 20, of the fuel injection valve 1 forms a precise air gap 27 so that there is a defined acceleration of the air.

The foregoing relates to preferred exemplary embodiments of the invention, it being understood that other variants and embodiments thereof are possible within the spirit and scope of the invention, the latter being defined by the appended claims.

We claim:

1. A device for injecting a fuel/air mixture into an engine, which comprises a fuel injection valve in a valve housing, a valve closing body interacting with a valve seating surface and, downstream of the valve seating surface, at least one fuel injection opening in an injection end (6, 20) of the fuel injection valve (1), a pot-shaped air envelope bush, which surrounds the injection end of the fuel injection valve, at least partially in the axial direction by means of a cylindrical part and at least partially in the radial direction by means of a bottom part, a mixture spray opening in said bottom part extending concentrically with the valve longitudinal axis, said bottom part (11) includes an inside wall (21), facing towards the injection end (6, 20) of the fuel injection valve (1), said bottom part (11) of the air envelope bush (4) has a radial annular surface (24) extending as far as the mixture spray opening (31) in said bush and at least two stop surfaces (26) protrude by a predetermined distance above the annular surface (24) in the axial direction towards the injection end (6, 20) and are in contact with the injection end so that a defined air gap (27) is formed between the injection end (6, 20) and the annular surface (24), said annular surface (24) is formed by an inner annular protrusion (23) which has a predetermined axial distance from the injection end (6, 20) that forms the air gap (27) through which air supplied between the injection end (6, 20) and the inner annular protrusion (23) flows, this air flow meeting a fuel sprayed via the at least one fuel injection opening (8) toward said mixture spray opening (31).

2. A device according to claim 1, in which at least one air supply opening (28) is formed in the cylindrical part (10).

3. A device according to claim 1, in which the stop surfaces (26) are formed by an outer interrupted annular protrusion (25) of the bottom part (11).

4. A device according to claim 2, in which the stop surfaces (26) are formed by an outer interrupted annular protrusion (25) of the bottom part (11).

5. A device according to claim 1, in which at least one distance piece (45) is arranged between the injection end (6, 20) of the fuel injection valve (1) and the stop surfaces (26).

6. A device according to claim 1, in which the mixture spray opening (14) extends in a funnel shape facing away from the injection end (6, 20).

7. A device according to claim 2, in which the mixture spray opening (14) extends in a funnel shape facing away from the injection end (6, 20).

8. A device according to claim 3, in which the mixture spray opening (14) extends in a funnel shape facing away from the injection end (6, 20).

9. A device according to claim 1, in which at least part of the inside (21) of the bottom part (11) between the stop surfaces (26) and the inner annular protrusion (23) extends obliquely towards the injection end (6, 20) in the radial direction towards the annular surface (24).

10. A device according to claim 1, in which a peripheral air supply groove (35), into which the at least one air supply opening (38) emerges, is formed in a cylindrical inner wall (34) of the cylindrical part (10).

11. A device according to claim 2, in which a peripheral air supply groove (35), into which the at least one air supply opening (38) emerges, is formed in a cylindrical inner wall (34) of the cylindrical part (10).

12. A device according to claim 3, in which a peripheral air supply groove (35), into which the at least one air supply opening (38) emerges, is formed in a cylindrical inner wall (34) of the cylindrical part (10).

13. A device according to claim 6, in which a peripheral air supply groove (35), into which the at least one air supply opening (38) emerges, is formed in a cylindrical inner all (34) of the cylindrical part (10).

14. A device according to claim 9, in which a peripheral air supply groove (35), into which the at least one air supply opening (38) emerges, is formed in a cylindrical inner wall (34) of the cylindrical part (10).

15. A device according to claim 1, in which one annular groove (38, 40), which is used for accepting an upper sealing ring (39) or a lower sealing ring (41), is formed on each side of the at least one air supply opening (28) on the periphery of the air envelope bush (4).

16. A device according to claim 2, in which one annular groove (38, 40), which is used for accepting an upper sealing ring (39) or a lower sealing ring (41), is formed on each side of the at least one air supply opening (28) on the periphery of the air envelope bush (4).

17. A device according to claim 3, in which one annular groove (38, 40), which is used for accepting an upper sealing ring (39) or a lower sealing ring (41), is formed on each side of the at least one air supply opening (28) on the periphery of the air envelope bush (4).

18. A device according to claim 6, in which one annular groove (38, 40), which is used for accepting an upper sealing ring (39) or a lower sealing ring (41), is formed on each side of the at least one air supply opening (28) on the periphery of the air envelope bush (4).

19. A device according to claim 9, in which one annular groove (38, 40), which is used for accepting an upper sealing ring (39) or a lower sealing ring (41), is formed on each side of the at least one air supply opening (28) on the periphery of the air envelope bush (4).

20. A device according to claim 10, in which one annular groove (38, 40), which is used for accepting an upper sealing ring (39) or a lower sealing ring (41), is formed on each side of the at least one air supply opening (28) on the periphery of the air envelope bush (4).

21. A device for injecting a fuel/air mixture into an engine, which comprises a fuel injection valve in a valve housing, a valve closing body interacting with a valve seating surface and, downstream of the valve seating surface, at least one fuel injection opening, a pot-shaped air envelope bush, which surrounds an injection end of the fuel injection valve, at least partially in the axial direction by means of a cylindrical part and at least partially in the radial direction by means of a bottom part, at least one fuel injection opening in the bottom part, a mixture spray opening in said bottom part extending concentrically with the valve longitudinal axis, said bottom part (11) includes an inside wall (21), facing towards the injection end (6, 20) of the fuel injection valve (1), said bottom part (11) of the air envelope bush (4) has a radial annular surface (24) extending as far as a mixture opening (31) in said bush and at least two stop surfaces (26) protrude by a predetermined distance above the annular surface (24) in the axial direction towards the injection end (6, 20) and are in contact with the injection end so that a defined air gap (27) is formed between the injection end (6, 20) and the annular surface (24), through which air gap the air supplied between the injection end (6, 20) and the bottom part (11) flows, this air flow meeting a fuel sprayed via the at least one fuel injection opening (8) toward said mixture opening (31), and at least one distance piece (45) is arranged between the injection end (6, 20) of the fuel injection valve (1) and the stop surfaces (26).

22. A device according to claim 21, in which the mixture spray opening (14) extends in a funnel shape facing away from the injection end (6, 20).

23. A device according to claim 21, in which a peripheral air supply groove (35), into which the at least one air supply opening (38) emerges, is formed in a cylindrical inner wall (34) of the cylindrical part (10).

24. A device according to claim 21, in which one annular groove (38, 40), which is used for accepting an upper sealing ring (39) or a lower sealing ring (41), is formed on each side of the at least one air supply opening (28) on the periphery of the air envelope bush (4).

25. A device for injecting a fuel/air mixture into an engine, which comprises a fuel injection valve in a valve housing, a valve closing body interacting with a valve seating surface and, downstream of the valve seating surface, at least one fuel injection opening, a pot-shaped air envelope bush, which surrounds an injection end of the fuel injection valve, at least partially in the axial direction by means of a cylindrical part (10) and at least partially in the radial direction by means of a bottom part, at least one air supply opening (28) is formed in the cylindrical part (10), at least one fuel injection opening in the bottom part, a mixture spray opening in said bottom part extending concentrically with the valve longitudinal axis, said bottom part (11) includes an inside wall (21), facing towards the injection end (6, 20) of the fuel injection valve (1), said bottom part (11) of the air envelope bush (4) has a radial annular surface (24) extending as far as a mixture opening (31) in said bush and at least two stop surfaces (26) protrude by a predetermined distance above the annular surface (24) in the axial direction towards the injection end (6, 20) and are in contact with the injection end so that a defined air gap (27) is formed between the injection end (6, 20) and the annular surface (24), through which air gap the air supplied between the injection end (6, 20) and the bottom part (11) flows, this air flow meeting a fuel sprayed via the at least one fuel injection opening (8) toward said mixture opening (31), at least one distance piece (45) is arranged between the injection end (6, 20) of the fuel injection valve (1) and the stop surfaces (26).

26. A device for injecting a fuel/air mixture into an engine, which comprises a fuel injection valve in a valve housing, a valve closing body interacting with a valve seating surface and, downstream of the valve seating surface, at least one fuel injection opening, a pot-shaped air envelope bush, which surrounds an injection end of the fuel injection valve, at least partially in the axial direction by means of a cylindrical part and at least partially in the radial direction by means of a bottom part, at least one fuel injection opening in the bottom part, a mixture spray opening in said bottom part extending concentrically with the valve longitudinal axis, said bottom part (11) includes an inside wall (21), facing towards the injection end (6, 20) of the fuel injection valve (1), said bottom part (11) of the air envelope bush (4) has a radial annular surface (24) extending as far as a mixture opening (31) in said bush and at least two stop surfaces (26) formed by an outer interrupted annular protrusion (25) of the bottom part (11) protrude by a predetermined distance above the annular surface (24) in the axial direction towards the injection end (6, 20) and are in contact with the injection end so that a defined air gap (27) is formed between the injection end (6, 20) and the annular surface (24), through which air gap the air supplied between the injection end (6, 20) and the bottom part (11) flows, this air flow meeting a fuel sprayed via the at least one fuel injection opening (8) toward said mixture opening (31), and in which at least one distance piece (45) is arranged between the injection end (6, 20) of the fuel injection valve (1) and the stop surfaces (26).

* * * * *